United States Patent [19]

Johnston et al.

[11] 3,952,533

[45] Apr. 27, 1976

[54] MULTIPLE VALVE REFRIGERATION SYSTEM

[75] Inventors: William C. Johnston, Atlanta, Ga.; Sterling Beckwith, Menlo Park, Calif.

[73] Assignee: Kysor Industrial Corporation, Cadillac, Mich.

[22] Filed: Sept. 3, 1974

[21] Appl. No.: 502,439

[52] U.S. Cl. ..... 62/115; 62/216; 62/513

[51] Int. Cl.[2] ..... F25B 41/00

[58] Field of Search ..... 62/216, 513, DIG. 17, 62/113, 114, 115; 236/92 B

[56] References Cited

UNITED STATES PATENTS

| | | | |
|---|---|---|---|
| 2,252,300 | 8/1941 | McGrath | 62/DIG. 17 |
| 3,434,299 | 3/1969 | Nussbaum | 62/DIG. 17 |
| 3,446,032 | 5/1969 | Bottum | 62/513 |

*Primary Examiner*—William F. O'Dea
*Assistant Examiner*—Ronald C. Capossela
*Attorney, Agent, or Firm*—Price, Heneveld, Huizenga & Cooper

[57] ABSTRACT

An energy saving refrigeration system as for refrigerated display cases in stores, free of the usual winter head pressure controls on the condenser equipment, capable of functioning satisfactorily with two-phase, liquid-gas mixtures of refrigerant inlet flow, there being a pair of valves immediately upstream of the evaporator, one being an expansion valve, and the other being a pressure regulator just upstream of the expansion valve adjusted such as to maintain a fixed discharge pressure to the expansion valve, this regulator discharge pressure set sufficiently above the evaporator boiling pressure and set sufficiently below the minimum inlet pressure to the pressure regulator.

5 Claims, 5 Drawing Figures

| DISCHARGE PRESSURE P.S.I. | AMBIENT TEMP. °C | APPROX BTU/WATT |
|---|---|---|
| 230 | +90 | 4.5 |
| 200 | +80 | 4.7 |
| 170 | +70 | 5.5 |
| 150 | +60 | 5.8 |
| 125 | +50 | 6.1 |
| 105 | +40 | 6.6 |
| 90 | +30 | 7.4 |
| 72 | +20 | 7.75 |
| 60 | +10 | |
| 45 | 0 | |

PRESSURE-ENTHALPY DIAGRAM
"FREON-502"
REFRIGERANT
TEMP. in °F ENTROPY in Btu/(lb)(°R)
VOLUME in cu ft/lb
SATURATED LIQUID
SATURATED VAPOR
ENTROPY
TEMPERATURE
VOLUME
SCALE CHANGE
PRESSURE (PSIA)
ENTHALPY (Btu/lb. above Saturated Liquid at -40°F)

MULTIPLE VALVE REFRIGERATION SYSTEM

BACKGROUND OF THE INVENTION

This invention relates to a refrigerant system of the type typically used in refrigerated display cases as for frozen foods or the like, and more particularly relates to a refrigeration system employing a multiple valve arrangement upstream of the evaporator.

Efficient marketing of frozen-food products since the early 1960's has contributed significantly to the general health and welfare of the consumer. One substantial factor enabling the efficient marketing of frozen-food products has been the wide-spread adoption of refrigerated display cases by grocery stores, with the most popular in recent years being the open front, multiple air-curtain type. These display cases are usually so-called "low temperature" cases for frozen foods, and "normal temperature" cases for meat, dairy products, and the like. The more common "low temperature" type are maintained at evaporator temperatures in the range of approximately minus 25° F. to assure the frozen foods being properly kept. These display cases achieve refrigeration by the cooling phenomenon occurring with evaporation of a refrigerant such as Freon from a liquid state to a gaseous state. This is achieved by passing the liquid through an expansion valve, converting it to a gas as it flows into and through the evaporator coils in the display case where heat exchange occurs. The evaporated refrigerant gas is then compressed, causing heating, is cooled to remove this heat by passage through a condenser which liquifies the compressed gas refrigerant, and recycled back, usually through one or more storage vessels, to the expansion valve and evaporator. The condenser is cooled by air flow or liquid flow, usually the former.

Because the condenser is often located exteriorly of the building containing the display cases for air cooling by outside air, it is subjected to widely varying ambient air temperatures. Hence, the condensed refrigerant leaving the condenser will be cooled differing amounts depending upon the season. This causes the departing refrigerant pressure to vary widely. During winter months, especially in northern climates, cooling of the refrigerant can be so significant that the low pressure of the refrigerant leaving the evaporator can cause difficulties at the expansion valve. Hence, conventional practice is to install what are known in the trade as winter head pressure controls, at the condenser, to keep the pressure of the liquid refrigerant up to a certain minimum value. The purpose of such systems is to provide totally liquid phase refrigerant to the expansion valve which cannot tolerate any significant amount of refrigerant gas. Consequently, the refrigerant must be totally condensed to a liquid phase in the condenser, and held there until the compressor pumps the pressure up to a condition where the expansion valve can be guaranteed an all-liquid inlet refrigerant. Stated differently, the winter head pressure controls on present outdoor condensers never allow liquid-line pressures to drop below a predetermined value, usually approximately 165 PSIG for Refrigerants 22 and 502; and 100 PSIG for Refrigerant 12. In order to maintain such a pressure, the compressor is required to work over and above that necessary to produce the load refrigeration necessary for cooling. This requires very significant amounts of extra energy.

SUMMARY OF THE INVENTION

It is an object of this invention to provide a novel simplified refrigeration system or combination that has demonstrated the capability to provide power savings ranging from about 20 to about 60%. Power savings of approximately 33% in comparison to the conventional equipment can readily be achieved, with the best point power savings in the range of 50 to 60% occurring during steady state operation in some installations and colder climates where the mean ambient outdoor temperatures are 25° F. or less. Power savings continue up to temperatures of approximately 80° F. The purpose of the novel system therefore is to enable the operator of condensing units employing outdoor air-cooled condensers to save substantial power during winter operation. Considering the large number of stores using such systems, the potential power savings are very substantial.

Another object of this invention is to provide a novel refrigerant system that functions on two phase refrigerant, i.e. gas and liquid, as well as single phase. It is free of winter head pressure controls. Moreover, the initial cost and complexity of the system is not substantially higher than and generally comparable to that of the conventional system.

A dual valve arrangement adjacent the evaporator is used, including a pressure regulator set to keep the refrigerant at a preset constant operating pressure, followed by a refrigerant expansion valve. Both valves are functional with two-phase refrigerant flow as well as single-phase all-liquid refrigerant flow.

Another object of this invention is to provide a novel refrigeration method employing two-phase refrigerant, wherein the refrigerant, after compression, is condensed to a liquid condition, maintained in a pressure range at the condenser head pressure encountered from cold winter air cooling and above the pressure necessary to maintain needed evaporation cooling, and then routed to the valves and the evaporator, frequently gaining temperature in the process during winter operation and, therefore, entering the novel valve arrangement as a two-phase refrigerant mixture, after which it is fully expanded to a gaseous phase at constant pressure within the evaporator to cause cooling thereby.

The refrigeration achieved is comparable in cooling capacity to that of conventional systems, both winter and summer. Case temperature pull down after defrost is fully satisfactory. Reliability is believed equal to that of conventional systems because of similarity in type and quality of components.

Once the concept of this invention is understood, it will appear very simple to those skilled in this field. Indeed, this is one of its major attributes, in conjunction with the admirable power saving results achieved.

These and other objects of this invention will be apparent upon studying the following specification in conjunction with the drawings.

DESCRIPTION OF THE PREFERRED EMBODIMENT

This system was originally developed for low temperature refrigeration applications, i.e. minus 25° F. evaporator temperature, especially for low temperature refrigerated display cases. The potential power savings is the greatest on low temperature equipment. However, this system can be employed to some advantage in so-called commercial or normal temperature equipment, as for example, in meat or dairy display case cooling systems or other refrigeration systems employing evaporation cooling.

Figure 1:
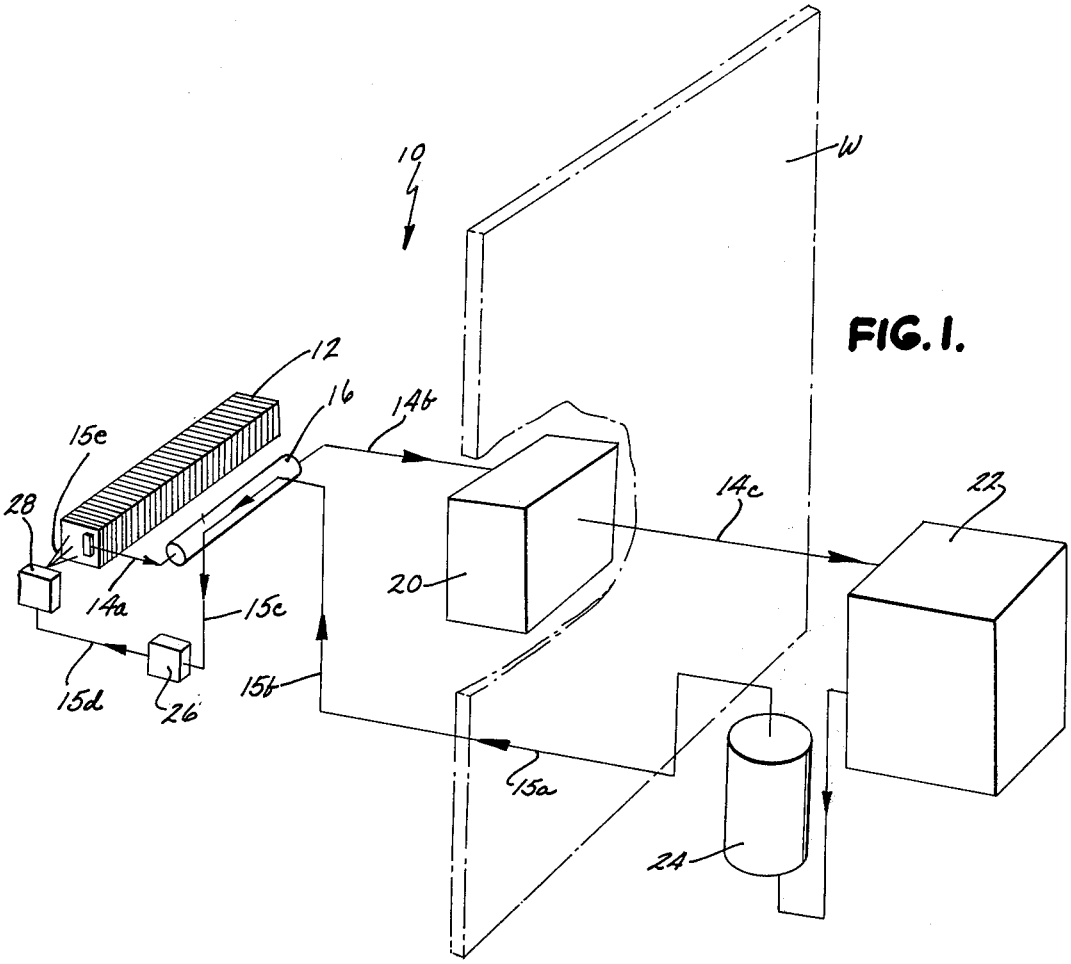
FIG. 1 is a schematic diagram of the novel system.

Referring now specifically to FIG. 1, the components of the combination system are depicted schematicaly relative to an interior-exterior wall W. Specifically, the system 10 includes a typical conventional evaporator 12, usually of finned coil type, a conduit 14 including outlet leg 14*a* that leads to a high efficiency subcooler 16 of conventional known type, the conduit leg 14*b* then leading to a conventional compressor 20. The outlet conduit leg 14*c* extends through wall W downstream of the compressor to the outdoor condenser 22. Flow of outdoor ambient air over the outdoor condenser coils causes cooling and condensation of the refrigerant in the coils.

The cooled refrigerant then flows through leg 15*a* of conduit 15 for storage in suitable storage tanks 24. As needed, the refrigerant flows from storage tanks through wall W to the interior of the building through conduit leg 15*b*, through sub-cooler 16 to be precooled by refrigerant in conduit leg 14*a* leaving the evaporator. The refrigerant then flows through conduit leg 15*c* to pressure regulator 26, then conduit leg 15*d* to expansion valve 28 and through multiple parallel conduit legs 15*e* to the coils of evaporator 12.

Evaporator 12 is of conventional construction, e.g. including the typical heat exchanger fin and coil arrangement well known in the refrigerant field. The sub-cooler 16 is of the high efficiency type available in the trade. It causes heat exchange between the cooled gases leaving the evaporator and flowing through conduit 14, and the sometimes two phase gas — liquid refrigerant in conduit 15. Compressor unit 20 is also of conventional construction, receiving the low pressure gaseous refrigerant, and compressing it to saturation pressure corresponding to the refrigerant condensing temperature's saturation pressure.

The condenser 22 is located outside of the building for cooling by flow of outdoor ambient air through the structure in conventional fashion, assisted usually by fans. However, in contrast to conventional units, no winter head pressure control mechanism is employed on the condenser. Thus there is nothing to restrain the discharge of liquid refrigerant at a certain liquid minimum pressure. In the novel system, this condenser liquifies the refrigerant, which then flows through conduit leg 15*a* to the storage tanks or reservoir 24. In traversing conduit leg 15*b*, the refrigerant is subject to heat transfer with the environs of the building interior. During summer operation with high condensing pressure temperature this heat transfer in leg 15*b* has the effect of sub-cooling the already liquid refrigerant since the building interior temperature is below condensing temperature. However, during cold weather operation, with building interior temperatures well above the refrigerant condensing temperature, the heat transfer path in leg 15*b* may be reversed with respect to summer operation, with the liquid refrigerant leaving reservoir 24 gaining heat in conduit leg 15*b* and, therefore, causing a certain portion of the refrigerant in leg 15*b* to change to gas, thereby constituting a two-phase refrigerant entering subcooler 16, and if sufficient heat was gained in leg 15*b* even entering the pressure regulator 26 as a two-phase refrigerant mixture. This first valve 26 thus constitutes a pressure regulator. The pressure regulator discharge pressure is adjusted to a value sufficiently low as to enable a year round condenser head variation without malfunction of the regulator, i.e. the pressure regulator discharge pressure is preset to a value sufficiently below the lowest condensing pressure associated with design minimum ambient temperature, and at a high enough pressure to achieve sufficient pressure drop through the subsequent expansion valve 28 to effectively supply sufficient refrigerant to the evaporator. The two phase gas-liquid refrigerant flows from pressure regulator 26 through conduit leg 15*d* to the expansion valves. This expansion valve 28 is of sufficient size to accommodate the liquid and gas mixture entering it. Typically, a system employing a one ton expansion valve for a one phase liquid refrigerant would employ approximately a 12 ton valve in place thereof for the two phase refrigerant.

The refrigerant, as it is being fully evaporated, passes into the evaporator and through its coils for cooling by heat exchange through the coil fins and tubes. This evaporator will be normally located in the refrigerated display case or other areas to be cooled, so that air can be forced over it for cooling purposes. The low pressure refrigerant is then recycled through the sub-cooler and back through the system. As noted previously, the potential power savings are very substantial, particularly for low temperature refrigeration systems.

Figure 2:
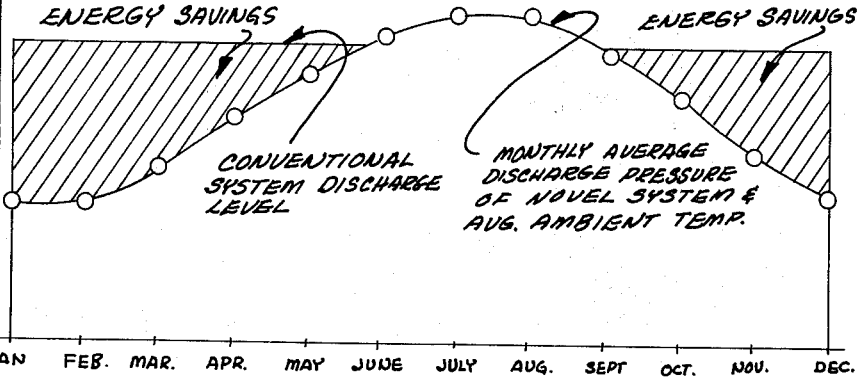
FIG. 2 is a chart showing a comparison of typical operating parameters of the novel system versus the conventional system in a climate like that of Chicago, Ill.

The magnitude of the power or energy savings can be seen from FIG. 2 which has been compiled for a low temperature air curtain type refrigerated display case operated in a climate comparable to that of the vicinity of Chicago, Illinois.

Figure 3:
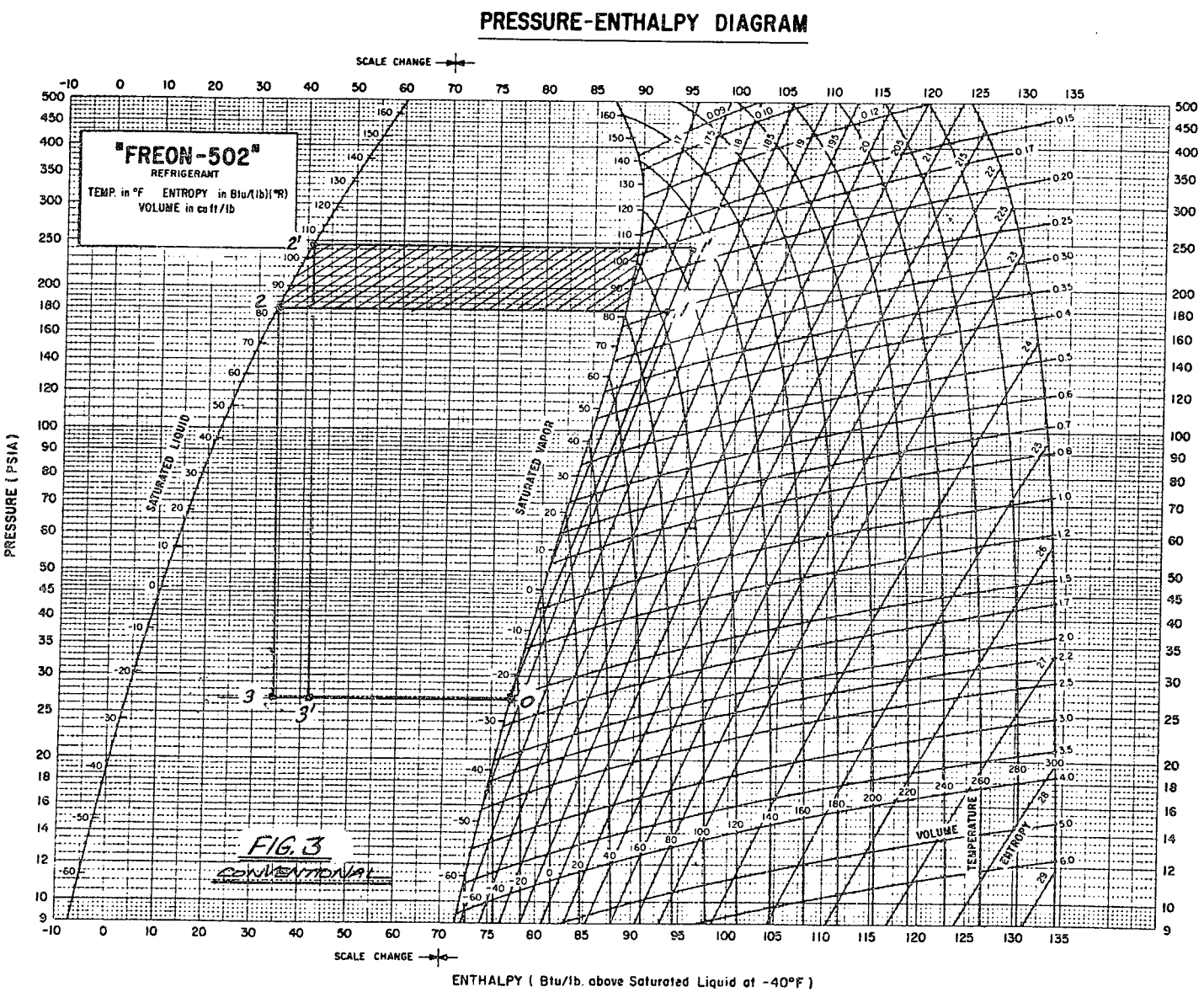
FIG. 3 PRIOR ART
FIG. 3 is a pressure-enthalpy diagram of the conventional equipment using a typical refrigerant.
Figure 4:
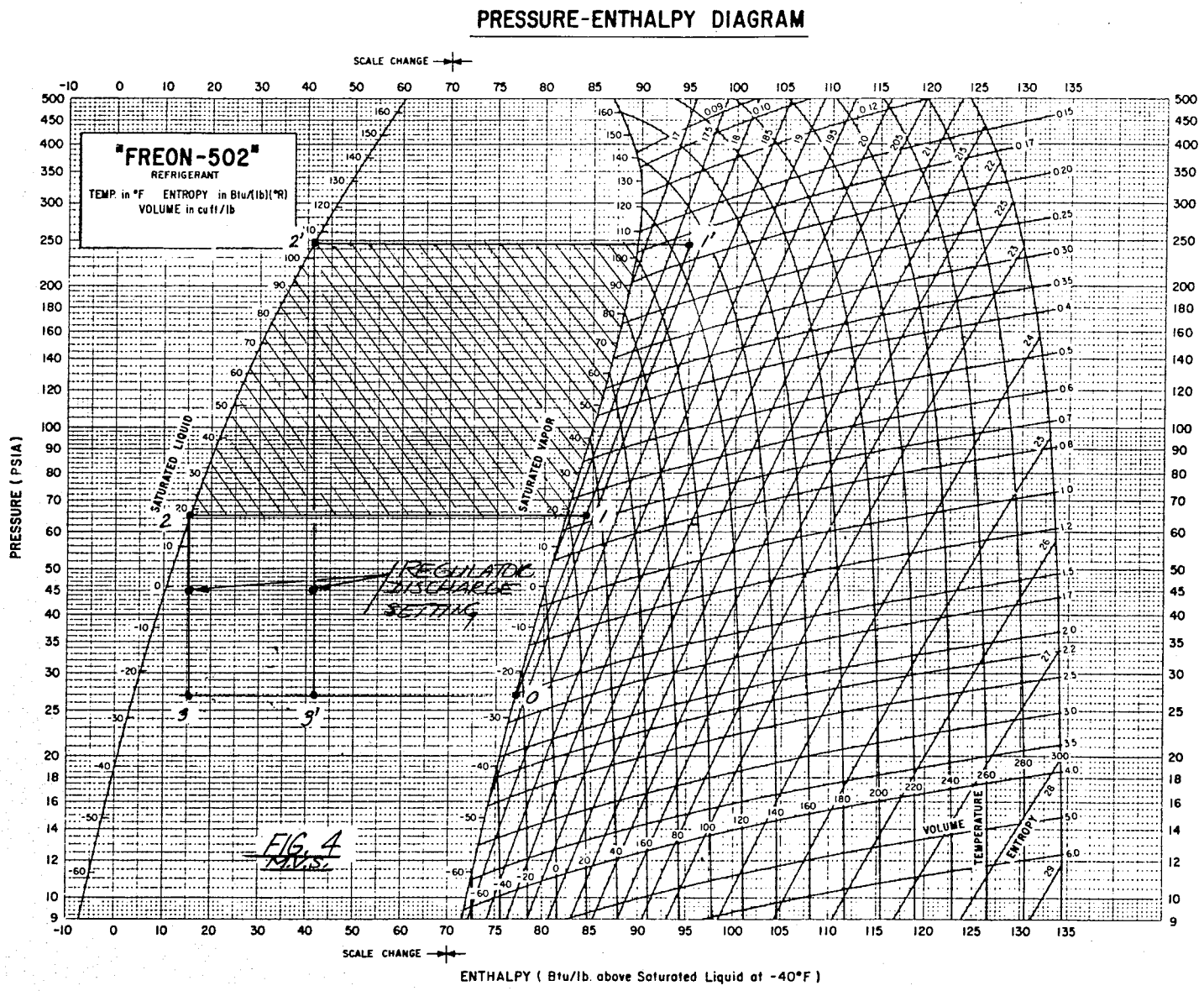
FIG. 4 PRIOR ART
FIG. 4 is a pressure-enthalpy diagram of the novel system using a typical refrigerant.

The following description of potential savings in a particular installation employing Freon refrigerant R-502 is set forth for illustrative purposes, reference being had to the pressure enthalpy diagrams, FIGS. 3 and 4.

The novel system (sometimes designated as MVS) is explained in detail hereinafter as designed to function over an inlet pressure range of 50 PSIG to 300 PSIG when used on evaporators boiling at 12 PSIG or lower. These pressures correspond to refrigeration system employing Freon R-502 as the refrigerant with a condensing temperature varying from 18°F to 125°F and an evaporator at −25°F or less.

The two valves comprise a high capacity pressure regulator upstream and in series with a high capacity thermostatic expansion valve. To qualify the term "high capacity", what is meant is that relative to conventional (evaporator expansion) valves, these components have larger physical flow areas at their maximum valve stroke. The reason for this is because the assembly will necessarily accommodate inlet flows that are mixtures of gas and liquid, whereas the conventional system is always guaranteed a liquid refrigerant at its inlet, and is designed for such. The gas/liquid mix passed by the assembly can occupy, on a per pound of refrigerant flow rate basis, a much larger volume than an all liquid refrigerant flow. In order to pass X pounds per hour of two-phase refrigerant, the valve flow areas must be substantially larger than an all liquid assembly passing X pounds per hour.

By way of example, consider an evaporator designed to boil at −25° F on R-502 with a conventional refrigerant supply system employing an air cooled condenser located exterior to the building. The latter is constructed so as to supply an all liquid refrigerant to the expansion valve, and with conventional winter head pressure controls on the condenser will provide a minimum liquid line pressure of approximately 165 PSIG during cold weather operation and a maximum liquid line pressure of 230 PSIG during steady operation at 105° F condensing temperature. The latter value can go higher. If the condenser ambient is at 120° F, then in all likelihood a condensing temperature of approximately 135° F will be encountered, which yields a liquid line pressure of approximately 338 PSIG. For the purpose of completeness, the case of a maximum of 230 PSIG rather than 338 PSIG will be discussed since the system is designed on the premise of 105° F condensing as a maximum. The equation for heat removed from its surroundings by the evaporator is $$(1)\ H = \dot{m}\,(h_{out\ of\ evap.} - h_{into\ evap.})$$

where

H~BTU/HR of refrigeration $\dot{m}$~LBm/HR refrigerant $h_{out\ of\ evap.}$~gas enthalpy of refrigerant leaving evap, BTU/LBm $h_{into\ evap.}$ ~liquid enthalpy of refrigerant entering the expansion valve, BTU/LBm Since the evaporator is boiling at −25° F, the $h_{out\ of\ evap}$ is a constant value. The inlet refrigerant enthalpy varies though, because the inlet liquid pressure/temperature vary with the condensing temperature shifts that accompany ambient temperature shifts. For a gas without superheat at −25° F, $h = 77.1$ BTU/LBm. For liquid without subcooling $h = 33.8$ BTU/LBm at 165 PSIG, and $h = 40.9$ BTU/LBm at 230 PSIG. Thus, the term ($h_{out\ of\ evap} - h_{into\ evap}$) can vary from 43.3 BTU/LBm to 36.2 BTU/LBm for minimum and maximum condensing temperatures respectively. Referring to equa. (1), for a constant load of 12,000 BTU/HR, over the course of its max and min inlet enthalpy swings the valve must supply either less or more refrigerant flow, m, in order to satisfy the constant load. Thus, at a condensing pressure of 165 PSIG, the equation reads $$12000\ \text{BTU/HR} = X_1\ \frac{\text{lbm}}{\text{hr}}\left(43.3\ \frac{\text{Btu}}{\text{lbm}}\right)$$

where $X_1 = 277.1$ lbm/hr at 165 PSIG condensing

For 230 PSIG condensing, the equation reads $$12000\ \frac{\text{BTU}}{\text{HR}} = X_2\ \frac{\text{lbm}}{\text{hr}}\left(36.2\ \frac{\text{Btu}}{\text{hr}}\right)$$

where $X_2 = 331.5$ lbm/hr at 230 PSIG condensing.

Therefore, the expansion valve must throttle over a range, for this example, of 277.1 to 331.5 lbm/hr. This throttling of the expansion valve is accomplished by means of varying the flow area within the valve itself. Equation (2) pertains to flow through an orifice, in this instance, the conventional expansion valve.

$$2.\ \dot{m} = ACd\ \sqrt{\Delta P\ \rho\ 2\ gc}, \text{ where}$$

$\dot{m}$ ~ lbm/sec refrigerant

A ~ physical flow area of valve orifice, $ft^2$

Figure 5:
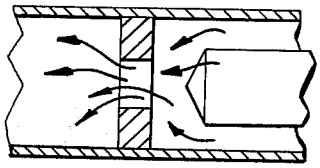
FIG. 5 is a schematic drawing of the expansion valve of the system.

Cd ~ orifice coefficient $\Delta P$ pressure across the orifice, $lb_f/ft^2$ $\rho$ ~ inlet density of refrigerant, $lb_f/ft^3$ $gc$ ~ gravitational constant, 32.2 lbm ft/$lb_f$ $sec^2$ FIG. 5 accompanies equa (2) as an illustrative supplement.

Table I lists the terms used in equa (2) with respect to the two condensing pressure extremes, 165 and 230 PSIG respectively, without subcooling.

TABLE 1

| CONDENSING PRESSURE (PSIG) | ΔP* ACROSS VALVE & DISTRIBUTOR (PSID) | ρVALVE INLET (LBm/FT³) | ṁ (lbm/hr) |
|---|---|---|---|
| 165 | 165 − 12 = 153. | 76.8 | 277.1 |
| 230 | 230 − 12 = 218. | 72.9 | 331.5 |

*ΔP = P valve inlet − P evaporator at boiling temp.

Substituting the above Table I values into equa (2) and solving for ACd of the valve for each condensing pressure.

$$ACd \text{ valve at 165 PSIG condense} = (\sqrt{\Delta P \rho 2 gc})^{-1}\ \dot{m}_{\text{165 PSIG condense}}$$

$$= \frac{277.1\ \text{lbm/HR}}{\sqrt{153.\ \frac{lb_f}{IN^2}\ 144\ \frac{IN^2}{FT^2}\ 76.8\ \frac{lbm}{ft^3}\ 64.4\ \frac{lbmFT}{lb_f SEC^2}\ 3600^2\ \frac{SEC^2}{HR^2}}}$$

$$= \frac{277.1}{3600\sqrt{10^8\,(1.089685)}} = \frac{277.1}{3600\,(10^4)\,1.0438797}$$

$$= \frac{277.1}{375.8\,(10^5)} = (.73736)\ 10^{-5}\ ft^2$$

$$ACd \text{ valve at 230 PSIG condenser} = \frac{331.5}{\sqrt{218.\,(144.)\,(72.9)\,(64.4)\,(3600.^2)}}$$

$$= \frac{331.5}{3600\sqrt{10^8\,(1.473779)}} = \frac{331.5}{437.04\,(10^5)} = .7585\ (10^{-5})\ ft^2$$

The significance in working through the above calculations resides in the fact that it is becoming explicitly apparent that the valve pintle on a standard expansion valve does not operate over a very wide distance, because for steady operation at either of the two condensing pressure extremes treated here the requisite flow ACd's (areas) differ by only 2.8 per cent.

Consider next the case of the novel pair of valves as part of a refrigeration system having a condensing pressure of 60.04 PSIG, which is in accordance with an outdoor condenser exposed to an ambient temperature of approximately 25° F. The refrigerant leaving the condensing unit is liquid with zero subcooling, but in traversing the distance between condensing and inlet to the valve assembly is subject to heat input from the building environment, resulting in a gain in temperature by the time the valves are reached, of say 4° F. FIG. 2 schematically represents this process, and includes some line pressure drop.

| ENTER DOUBLE VALVE ASSY. | | LEAVE CONDENSING UNIT |
|---|---|---|
| 58.73 PSIG, 30°F | FLOW | ALL LIQUID, NO SUBCOOLING |
| .01180 $\sqrt{f}$ | | .01182 ft³/lbm ~ $\sqrt{f}$ |
| .5757 $\sqrt{g}$ | | .5659 ft³/lbm ~ $\sqrt{g}$ |
| | 60.04 psig 26°F | 116.2 |
| 17.37 $\frac{\text{Btu}}{\text{lbm}}$ $h_f$ | | 17.65 $\frac{\text{Btu}}{\text{lbm}}$ ~ $h_f$ |
| 65.68 $\frac{\text{Btu}}{\text{lbm}}$ $h_{fg}$ | | 65.51 $\frac{\text{Btu}}{\text{lbm}}$ ~ $h_{fg}$ |
| 83.05 $\frac{\text{Btu}}{\text{lbm}}$ $h_g$ | | 83.16 $\frac{\text{Btu}}{\text{lbm}}$ ~ $h_g$ |

At the inlet to the valve assembly, the enthalpy of the fluid is 18.76 BTu/lbm which is in excess of the 17.37 BTu/lbm of an all-liquid refrigerant at 58.73 PSIG. The inlet fluid is therefore a two-phase mix of both liquid and gas. Equation (3) is useful in determining the extent of the gaseous constituent.

3. $h_x = h_f + x h_{fg}$, where $h_x$ = mixture enthalpy $h_f$ = liquid constituent enthalpy $h_{fg}$ = difference between liquid and gaseous enthalpies $x$ = abstract quantitative value called "quality"

Determining X, we have:

$$X = \frac{h_x - h_f}{h_{fg}} = \frac{18.76 - 17.37}{65.68} = .02116$$

The specific volume of the two phase mix is obtained using equation (4).

4. $\sqrt{x} = \sqrt{f} + X\sqrt{fg}$, where $\sqrt{fg} = (\sqrt{g} - \sqrt{f})$, ft³/lbm refrigerant

= .01180 + .02116 (.5757 − .01180)

= .01180 + .011932 = .0237321 ft³/lbm

The valve assembly must operate with either all liquid inlet refrigerant, as occurs with higher condensing pressures, or with two-phase inlet mixtures as may occur during low condensing pressures. A comparison of the liquid specific volume at high condensing pressures, 0.01371 ft³/lbm, with the two-phase inlet specific volume just computed of 0.02373 ft³/lbm illustrates why a large-ported valve is necessary. By comparison, a conventional valve with all-liquid at the inlet will see inlet specific volumes ranging from 0.0130 to 0.0137 ft³/lb for a condensing pressure range of 165 PSIG to 230 PSIG. On a percentage basis, the novel system inlet variance in refrigerant specific volume can be 73% vs. only 5.4% for the conventional system.

In the novel assembly the pressure regulating valve that is upstream of the expansion valve is provided so as to present an essentially constant pressure at the inlet to the expansion valve. Preferably, a thermostatically controlled expansion valve is used. The reason that a pressure regulating device is used is to diminish the amount of modulation required of the expansion valve as the latter seeks, through its thermostatically biased feed back control, to maintain a fixed, or nearly fixed, amount of superheat at the exit of the evaporator, where the thermostatic bulb is affixed. As with all pressure regulating devices, the regulator valve delivers a nearly constant discharge pressure even though it is subject to a wide range of inlet pressures. However, no pressure regulator can deliver a greater exit pressure than its inlet pressure, and in fact, in order to flow fluid at all must have an inlet pressure that is, to some extent, in excess of its discharge setting. There is, therefore, that minimum inlet pressure at which the regulating device is capable of delivering rated flow rate. Review of equa (2) confirms this statement, because for a fixed ACd at maximum wide-open regulator port area there is some ΔP, greater than zero, that is necessary to deliver rated m. For this reason, the discharge pressure setting of the pressure regulator portion of the assembly must always be less than the lowest condensing pressure that will be encountered, and by sufficient margin as to enable the regulator to pass the required demand flow sought by the expansion valve. Similarly, the discharge pressure of the regulating device must be higher than the evaporator boiling pressure, this to impart the requisite ΔP across the expansion valve to enable the latter to deliver the necessary amount of refrigerant.

FIG. 3 is a pressure-enthalpy chart that depicts the operating loop of a conventional refrigeration system using Freon R-502. FIG. 4 is also a pressure enthalpy chart, but pertains to an operating loop for a system incorporating the novel valve assembly. The shaded areas in both FIGS. 3 and 4 contain the allowable range of condensing temperatures. Note that the ordinate units are psia rather than psig. An upper limit of 230 psig was used for the condensing pressure maximum of the novel system, because this is the commonly considered highest value in commercial system steady-state operation. An isentropic line of compression was treated inasmuch as entropy gain vs. head rise is not well defined for the compressors over this range. Further, zero sub-cooling and zero superheat were considered. Since the pressure regulating valve and expansion valve are throttling devices, zero enthalpy change across each component was used.

The conventional system of FIG. 3 has a compressor operation over path 0-1 to 0-1', condenses across 1' to 2' or 1 to 2 as upper and lower condensing bounds respectively. The refrigerant expansion takes place along path 2–3 to 2' - 3', while actual refrigeration effect is along path 3-0 and 3'-0. FIG. 4 is essentially the same except that the upper and lower bounds of the condensing path are much further apart. The benefits of the sysem incorporating the novel assembly accrue as the condensing pressure drops below about 165 psig. The conventional system artificially maintains a minimum head pressure of about 165 psig in order to assure that a wholly liquid refrigerant is always supplied to the expansion valve. This pressure level is sustained by means of condenser fan cycling or bypassing the condenser with a fraction of compressor discharge gas, to operate as winter head pressure controls. Conversely, the FIG. 4 system allows the condensing pressure to fall in accordance with drops in the condenser cooling air temperature at least to the lower limit of path 1–2.

The savings in operating cost as afforded by the novel assembly will vary according to local climate and refrigeration load serviced by the system. However, examination of FIGS. 3 and 4 for disparity in required compressor work will provide some insight. In FIG. 3, the compressor minimal work is over path 0-1, as is FIG. 4, except path 0-1 is of lesser extent for the latter. The energy added to the refrigerant for FIG. 3 in the compression process is $\Delta h \simeq 92.5/1 - 77./0 = 15.5$ Btu/lbm

0-1 CONVENTIONAL MINIMUM while for the MVS, ref. FIG. 4.

$\Delta h$ is $84.2/1 - 77./0 = 7.2$ Btu/lbm

0-1 MVS MINIMUM

The refrigeration effect across the evaporator is path 3-0

$\Delta h_{3\text{-}0} \simeq 77./0 - 34/3 = 43.$ Btu/lbm refrig. conventional (FIG. 3)

$\Delta h_{3\text{-}0} \simeq 77./0 - 15.5/3 = 61.5$ Btu/lbm refrigeration MVS system (FIG. 4)

A fixed refrigeration load of H Btu/hr is dependent upon the enthalpy change across the evaporator, and the refrigerant mass flow rate through the evaporator, as noted in equa (1). Since path 3-0 was 61.5 Btu/lbm in the novel system vs. 43. Btu/lbm in the conventional system, less mass flow rate, m, is required of the novel system than of the conventional by the amount $$\dot{m}_{MVS} \; (\Delta h)_{mvs} = \text{constant load} = \dot{m}\,(\Delta h_{3\text{-}0})_{\text{conventional}}$$

$$\text{or: } \left.\frac{\dot{m}\; mvs}{\dot{m}_{\text{conven}}}\right|_{3\text{-}0} = \frac{43}{61.5} = 0.6992$$

Compressor specific work ratio between MVS and conventional was seen to be, over path 0-1:

$$\frac{\Delta h_{0\text{-}1}\; mvs}{\Delta h_{0\text{-}1}\; \text{conventional}} = 7.2/15.5 = 0.4645$$

Total power required of the compressor is a function of both mass flow rate, and energy added to the refrigerant during compression. That is:

$$H_{0\text{-}1} = \dot{m}\,(\Delta h_{0\text{-}1}), \quad \frac{\text{lbm}}{\text{hr.}} \times \frac{\text{Btu}}{\text{lbm}} \sim \frac{\text{Btu}}{\text{hr}}, \text{ power}$$

The ratio of compressor work for the MVS vs. the conventional system is most favorable to the MVS when paths 0-1-2-3 are treated for each of the two systems. This ratio, Hmvs/H conventional is indicative of the maximum possible savings that 0-1 0-1 can be derived from an MVS system, ideally.

$$\frac{\Delta H\; mvs\; 0\text{-}1}{\Delta H\; \text{conventional}_{0\text{-}1}} = \left(\frac{\dot{m}\; mvs}{\dot{m}\; \text{conventional}}\right)\left(\frac{\Delta h_{0\text{-}1}\; mvs}{\Delta h_{0\text{-}1}\; \text{conventional}}\right)$$

$$= .6992\,(.4645) = .3248$$

Therefore, under optimum conditions the MVS could cost only as much to operate as does a conventional system during steady operation.

Those familiar with this technology will readily appreciate the substantial energy savings possible, especially when applied to the many installations where such a system is immediately applicable. This and other important advantages of the invention are significant in the version set forth in detail herein as illustrative, it being realized that certain variations in arrangement, specific valve sizes and the like will be made to accommodate particular installations. Hence, the scope of the invention is to be limited only by the appended claims and the reasonable equivalents thereto.

The embodiments of the invention in which an exclusive property or privilege is claimed are defined as follows.

1. A continuous two-phase refrigeration system including refrigerant compressor means for compressing gaseous refrigerant, outside air cooled condenser means for cooling the compressed refrigerant, sub-cooler means for further cooling the compressed refrigerant with evaporator discharge refrigerant gas, evaporator means for heat exchange cooling of fluid therearound, and conduit means interconnecting said several means, the improvement comprising:

two-phase-refrigerant pressure regulator valve means for regulating refrigerant pressure and two-phase-refrigerant expansion valve means for refrigerant expansion, in succession along said conduit means, downstream of said sub-cooler means and upstream of said evaporator means, whereby a two-phase liquid-gas refrigerant can be continuously recirculated through the system.

2. The system in claim 1 wherein said condenser means is free of winter head pressure controls.

3. The refrigeration system in claim 1 wherein said pressure regulator valve means has a predetermined maximum pressure setting below the lowest condenser head pressure of the refrigerant thereto, and has a minimum pressure setting above the evaporator boiling pressure.

4. A method of refrigeration, employing outdoor air condensation, comprising the steps of:

compressing a gaseous refrigerant; cooling the compressed refrigerant with outside air until the refrigerant is in a two-phase gas-liquid condition; maintaining the two-phase refrigerant within a pressure range with a maximum pressure being at least as low as the lowest condenser head pressure encountered and the minimum pressure being above the pressure to maintain predetermined evaporator cooling; expanding the two-phase refrigerant to cause cooling thereby, and repeating the sequence.

5. The method in claim 4 wherein said minimum pressure is above the evaporator boiling pressure.

* * * * *